US006080001A

United States Patent [19]

Wong

[11] Patent Number: 6,080,001

[45] Date of Patent: Jun. 27, 2000

[54] POSITIVE RETENTION SLEEVE FOR MODULAR CONNECTOR

[75] Inventor: Kyin Pauk Wong, San Francisco, Calif.

[73] Assignee: @POS.COM, Inc., San Jose, Calif.

[21] Appl. No.: 09/265,019

[22] Filed: Mar. 9, 1999

[51] Int. Cl.[7] ..... H01R 4/50

[52] U.S. Cl. ..... 439/344; 379/438

[58] Field of Search ..... 439/344, 736, 439/491, 352, 354; 379/438

[56] References Cited

U.S. PATENT DOCUMENTS

| | | | |
|---|---|---|---|
| 4,647,726 | 3/1987 | Bulm | 379/438 |
| 5,334,044 | 8/1994 | Falossi et al. | 439/491 |
| 5,462,457 | 10/1995 | Schroepfer et al. | 439/736 |
| 5,620,335 | 4/1997 | Siemon | 439/491 |

*Primary Examiner*—Steven L. Stephan
*Assistant Examiner*—Amir Abdulmelik
*Attorney, Agent, or Firm*—Flehr Hohbach Test Albritton & Herbert LLP

[57] ABSTRACT

Inadvertent disconnection between a receptacle and a modular connector is achieved by fitting the connector with a new type of protective sleeve. The sleeve interior defines a first cavity sized to accept the connector and further defines a smaller cavity sized to admit the projecting connector tail. With the connector mated to the receptacle, the sleeve is slid forward. The exposed portion of the connector fits within the first sleeve cavity, and the connector tail fits within and is captured by the smaller cavity. The smaller cavity defines a connector tail capture region that constrains movement of the connector tail. More particularly, the capture region prevents unintended movement of the connector tail in a direction that would release the connector from the receptacle. This arrest feature prevents interruption of the connector-receptacle mechanical and electrical connection. To remove and unmate the connector from the receptacle, the sleeve is slid rearward until the connector tail is no longer constrained within the connector tail capture region. The connector tail may then be moved downward or in another connector freeing direction, permitting unmating of the connector-receptacle connection.

20 Claims, 3 Drawing Sheets

POSITIVE RETENTION SLEEVE FOR MODULAR CONNECTOR

FIELD OF THE INVENTION

This invention relates generally to modular connectors and receptacles, and more specifically to mechanisms that prevent inadvertent disconnection between such connectors and receptacles.

BACKGROUND OF THE INVENTION

Modular connectors and receptacles find widespread use in applications including telephone connections, general communications systems connections, as well as computer network connections.

FIG. 1 depicts a common network RJ-45 type modular connector or plug 10 that can detachably mate with a receptacle 20. Although receptacle 20 is depicted as being wall-mounted, it is understood that the receptacle may instead be mounted at the end of a mating length of cable, to form a cable-to-cable interconnection.

Connector 10 is typically fabricated from plastic with a forward portion 30 whose front lower surface presents a number of wire connections 40 to mating connections 50 found within receptacle 20. A cable 60, containing a number of wire conductors 65 is physically connected to at least the rear portion 80 of connector 10. Electrical contact between at least some of the wire conductors 65 and the connections 40 is usually made by crimping the end of cable 60 into the rear portion 80 of connector 10.

Connector 10 normally includes a somewhat resilient connector tail 90 that projects rearward from the front portion of the connector. The shape of the opening 100 in the mating receptacle includes a small rectangular opening 110. Opening 110 is sized to receive and retain a thickened portion 95 of the connector tail is retained, upon connector-receptacle mating. This retention is necessary to maintain mechanical and thus electrical connection between connector 10 and receptacle 20.

Connector-receptacle connection is made by inserting the connector into the receptacle fully, and relying upon retention of tail portion 95 by the wall of region 110 in the receptacle. But for this retention, the integrity of the connector-receptacle contacts is not ensured. To release the connector from the receptacle, one merely urges connector tail 90 downward toward cable 60 (e.g., away from rectangular opening 110) until the thickened tail portion 95 can escape the narrower opening 110 in the receptacle. The ability of the distal tail portion (e.g., the exposed portion of the tail) to move up and down to facilitate engagement and disengagement from a receptacle is shown in FIG. 1 by the double-arrowed curve adjacent tail 90.

A somewhat flexible sleeve 120 may be provided to protect connector 10, including protection against inadvertent disconnection from receptacle 20. In use, cable 60 is passed through a cable-sized opening 70 in the rear portion of the sleeve. The sleeve is then slid forward over the connector. Once in place, the sleeve provides some protection to tail 90 in that the sleeve can prevent substantial upward movement of the distal tail portion. Unfortunately the sleeve does little or nothing to prevent accidental downward movement of tail 90, which movement can result in inadvertent disconnection between connector and receptacle.

An intermittent contact between connector and receptacle connections in a telephone installation may only result in a noisy conversation. How ever in a computer network or telephone modem environment such intermittency can result in serious corruption or loss of data.

What is needed is a preferably simple mechanism to maintain and protect the connection integrity between a modular-type connector and its mating receptacle. The present invention provides such a mechanism.

SUMMARY OF THE PRESENT INVENTION

The present invention provides a modular connector with a protective hood-like sleeve that defines first and second cavities. The first cavity communicates with the front and rear regions of the sleeve. At the front region, the first cavity defines a chamber sized sufficiently large to encompass at least a portion of the modular connector. At the rear region, the first cavity defines an opening sized to pass a cable connectable to the connector. The second cavity is defined in the front region of the sleeve and forms a capture region that can capture at least a portion of the connector tail to prevent unwanted tail movement.

The hood-like sleeve may be integrally formed as a one-piece sleeve in which the first and second cavities are formed, e.g., by molding. Alternatively the hood-like sleeve may be formed compositely by fabricating the connector tail capture region as a discrete tube-like member that is then attached to the interior of the first cavity. In either embodiment the capture region will have a cross-section transverse dimension and a length sized to accept and capture at least a portion of the connector tail. The cross-section of this region may be rectangular or non-rectangular, e.g., circular, elliptical, or otherwise.

In use, the modular connector is mated with a receptacle and the protective sleeve is slid forward over the connector. At least a portion of the connector will be received into the first cavity, and at least a portion of the connector tail will fit into the second cavity. Once within the second cavity, unwanted movement of the connector tail is arrested, especially downward, e.g., in the direction that can release the connector from the receptacle.

Thus, with the sleeve in place, the connector tail cannot be moved downward, and indeed preferably cannot be moved in any direction. Since the modular connector cannot be released from the mating receptacle unless the connector tail is moved downward, the sleeve ensures positive connector-receptacle mechanical and electrical connection. To remove the connector from the receptacle, the sleeve is slid rearward, freeing the connector tail from the tail capture region of the sleeve. The sleeve may be fabricated from inexpensive materials such as rubber, plastic, or the like, using ordinary fabrication processes.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1:
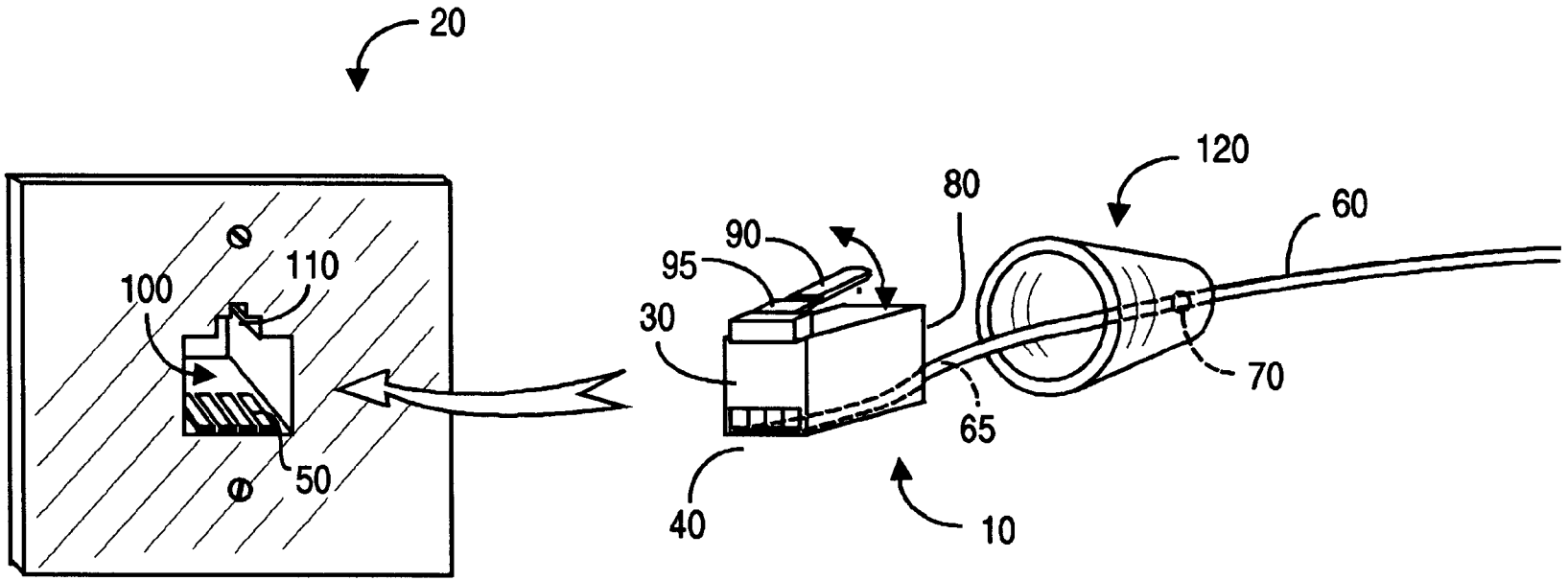
FIG. 1 (PRIOR ART)
FIG. 1 depicts connection between a receptacle and a modular connector with a sleeve, according to the prior art.
Figure 2:
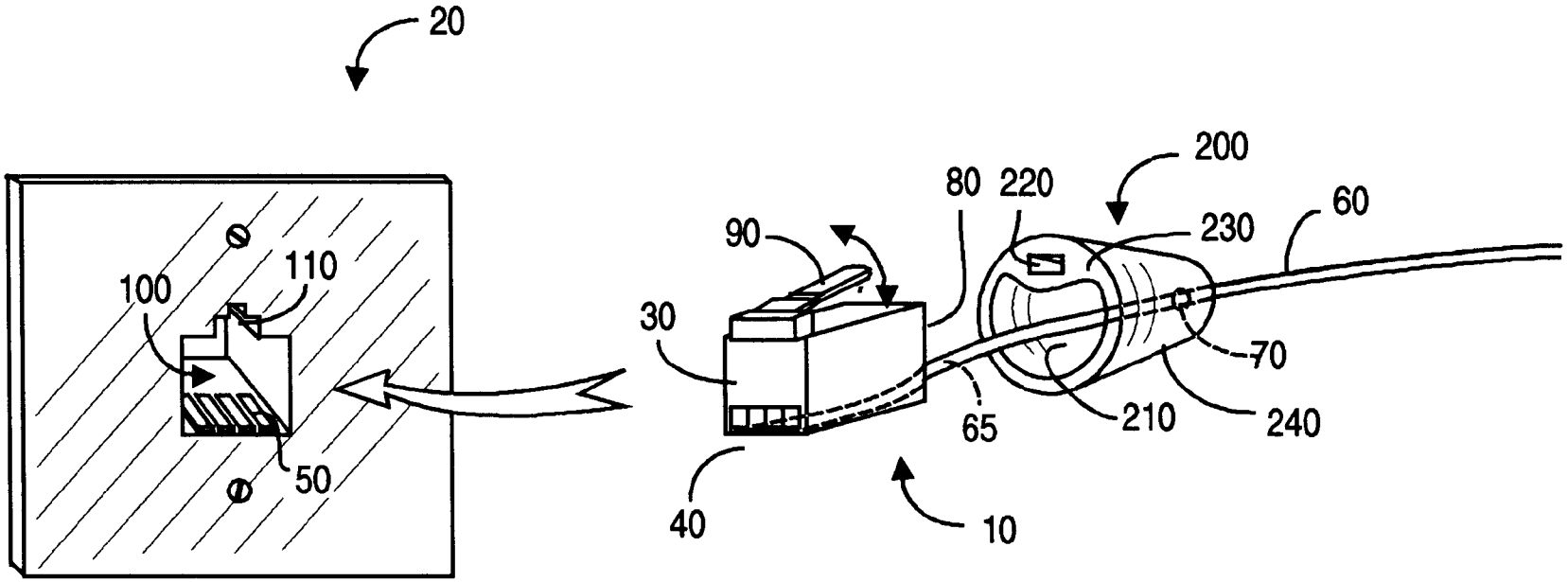
FIG. 2 depicts connection between a receptacle and a modular connector with a sleeve according to the present invention.

FIG. 2 is similar to FIG. 1 except for connector sleeve 200. It is seen that forward region 230 of the connector sleeve defines a large first cavity region 210 that is sized to fit over at least the rear portion of modular connector 10, if indeed not over all of the connector. This first cavity region communicates with a rear portion of the sleeve in which there is formed an opening 70 sized to accept a cable 60 that is attachable to the connector. Typically the circumference of opening 70 will be somewhat resilient to assist in frictionally retaining cable 60 as well as in providing strain relief for the cable.

Figure 4A:
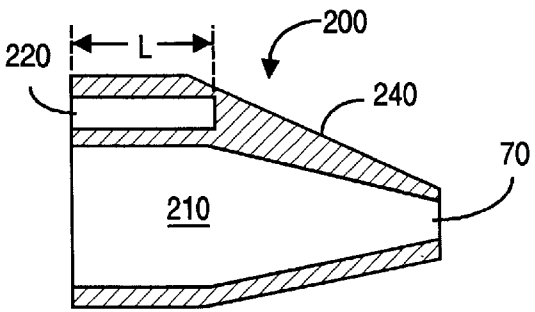
FIG. 4A is a cross-sectional view of the sleeve of FIG. 3A, according to the present invention.
Figure 4B:
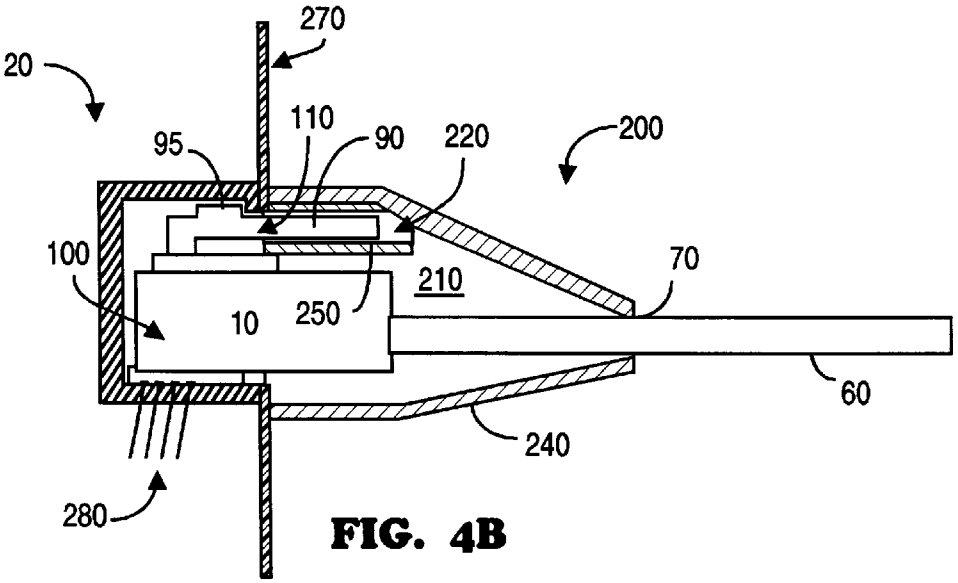
FIG. 4B is a cross-sectional view showing connection between a receptacle and a modular connector with a sleeve as shown in FIGS. 3B or 3C, according to the present invention.

In contrast to what was shown in FIG. 1, forward region 230 of sleeve 200 defines a second, smaller, cavity 220. This second cavity will be referred to herein as connector tail capture region 220. Region 220 is sized to fit over and capture at least a portion (if not all) of connector tail 90 of modular connector 10. As such, the cross-sectional transverse dimension ("A") of connector tail capture region 220 need not be much greater than the cross-sectional transverse dimension of the distal portion of connector tail 90. As shown in FIGS. 4A and 4B, length ("L") of the connector tail capture region will be sufficiently long to receive the exposed length of connector tail 90 when the connector is mated to a receptacle.

Figure 3A:
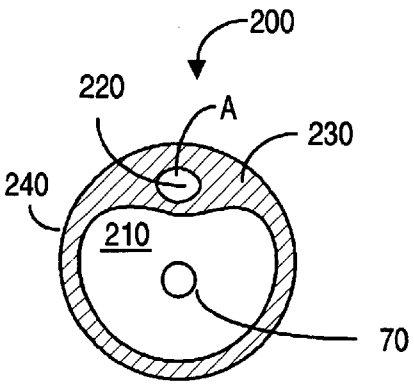
FIGS. 3A, 3B, 3C are front views of different embodiments of a connector sleeve, according to the present invention.

As shown in FIG. 3A, tail capture region 220 may be formed as an integral portion of a hood-like member 240, comprising sleeve 200. As such, sleeve 200 may be integrally formed as a single piece of material 240 that defines a large cavity region 210 and a smaller cavity region 220.

Figure 3B:
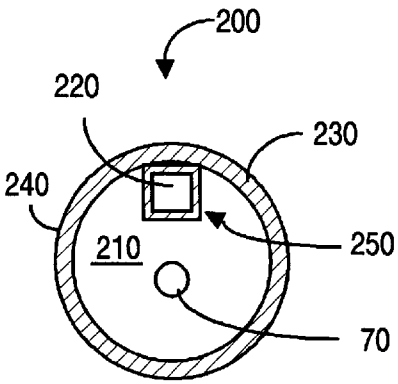
Figure 3C:
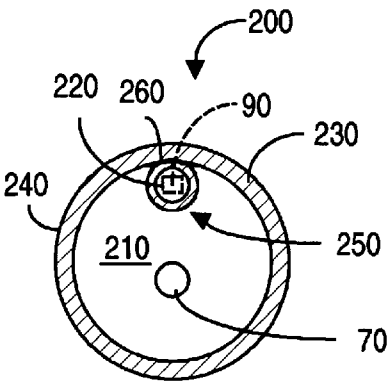

As suggested by FIGS. 3A, 3B and 3C, the cross-sectional size and shape of tail capture region 220 need only be sufficiently large to prevent substantial downward movement of connector tail 90, e.g., movement in the direction that would permit the connector to disengage or unmate from the receptacle. As such, the shape of this region need not be the same shape as a cross-section of the connector tail itself.

Thus, although connector tail 90 typically will have a somewhat rectangular cross-section, tail capture region 220 may be differently shaped. By way of example, capture region 220 is shown as being elliptically shaped in FIG. 3A, rectangularly shaped in FIG. 3B, and circularly shaped as shown in FIG. 3C. In FIG. 3C, the relative size and shape of the cross-section of connector tail 90 is shown in phantom. Of course, the free space surrounding connector tail 90 in tail capture region 220 may be relatively greater or smaller than what is depicted.

It is understood that other shapes, sizes, and configurations for capture region 220 may be adopted. The important consideration is that the capture region at least arrests excessive movement within the sleeve of the connector tail in a direction that would permit unintended disengagement of the connector from a mating receptacle.

As further shown by FIGS. 3B and 3C, tail capture region 220 may be formed as a separate sleeve member 250 that is then mechanically bonded (e.g., with adhesive 260, with heat, or using other attachment mechanisms) to the inner wall of cavity 210 formed in hood-like member 240. The resultant sleeve 200 will then be understood to be composite, although the same type material may in fact be used to form sleeve hood-like sleeve 240 and sleeve member 250.

FIG. 4A is a cross-section of an embodiment such as shown in FIG. 3A, in which tail capture region 220 is integrally formed within sleeve 200. As noted, the length L of region 220 should be sufficiently long to accept the length of connector tail 90.

FIG. 4B depicts the mating between modular connector 10 with sleeve 200, and receptacle 20, here shown mounted on a wall 270. In FIG. 4B, electrical connection to receptacle 20 is made via wires 280 that may be attached to other cables or equipment. (It is understood, however, that receptacle 20 need not be wall mounted and may instead be attached to the free end of another length of cable.) It will be appreciated from FIG. 4B that with sleeve 200 in place, connector tail 90 is substantially captured and constrained in its movement. For example, in contrast to prior art FIG. 1, sleeve 200 prevents connector tail 90 from being moved downward, a motion that could permit the connector-receptacle connection to be intermittent or totally lost. Connector tail 90 is also protected against upward, sideways or other motion that might damage or break off the connector tail. sleeve 200 may be fabricated from a somewhat flexible rubber-like or flexible plastic or other inexpensive, lightweight resilient material, for example using a molding process. If desired, sleeve 200 may be made less resilient, using plastic or similar material. Modular connector 10 may be released from receptacle 20 by sliding sleeve 200 rearward, away from the receptacle. Once the sleeve is moved rearward, the distal end of connector tail 90 is once more free to move or be moved downward (or in another release-direction), whereupon release from the receptacle is achieved.

Modifications and variations may be made to the disclosed embodiments without departing from the subject and spirit of the invention as defined by the following claims.

What is claimed is:

1. A sleeve to maintain connection between a receptacle and a mating modular connector having a connector tail, comprising:

a hood having a front portion defining a first cavity sized to fit over at least a rear portion of said connector, said first cavity communicating with a rear portion of said hood so as to define an opening sized to admit a cable attachable to said connector, said hood further defining a second cavity sized to accept at least a distal portion of said connector tail, said hood including a wall portion separating at least part of said first and said second cavity.

2. The sleeve of claim 1, wherein said second cavity defines a connector tail capture region configured to constrain movement of said distal portion of said connector tail in a direction that would permit release of said connector from said receptacle.

3. The sleeve of claim 1, wherein said hood comprises a single piece of material in which said first cavity and said second cavity are formed.

4. The sleeve of claim 1, wherein said hood includes a sleeve-like member in which said first cavity is defined, and includes a tube-like member in which said second cavity is defined;

wherein said tube-like member is attached to an inner surface region of said sleeve-like member.

5. The sleeve of claim 1, wherein said second cavity defines a rectangular cross-section.

6. The sleeve of claim 4, wherein said second cavity defines a circular cross-section.

7. The sleeve of claim 4, wherein said second cavity defines an elliptical cross-section.

8. The sleeve of claim 4, wherein said sleeve-like member is attached to said inner surface region using a technique selected from a group consisting of (a) attachment is made with an adhesive, and (b) attachment is made with thermal bonding.

9. The sleeve of claim 1, wherein said sleeve is fabricated from rubber.

10. The sleeve of claim 1, wherein said sleeve is fabricated from plastic.

11. A modular connector assembly, comprising:

a modular connector including a connector body having a first region defining electrical connections and a second region having a connector tail resiliently extending therefrom; and a hood having a front portion defining a first cavity sized to fit over at least a rear portion of said modular connector, said first cavity communicating with a rear portion of said hood so as to define an opening sized to admit a cable attachable to said modular connector, said hood further defining a second cavity sized to accept at least a distal portion of said connector tail, said hood including a wall portion separating at least part of said first and said second cavity.

12. The modular connector assembly of claim 11, wherein said second cavity defines a connector tail capture region configured to constrain movement of said distal portion of said connector tail in a direction that would permit release of said modular connector from said receptacle.

13. The modular connector assembly of claim 11, wherein said hood comprises a single piece of material in which said first cavity and said second cavity are formed.

14. The modular connector assembly of claim 11, wherein said hood includes a sleeve-like member in which said first cavity is defined, and includes a tube-like member in which said second cavity is defined;

wherein said tube-like member is attached to an inner surface region of said sleeve-like member.

15. The modular connector assembly of claim 11, wherein said second cavity defines a cross-section selected from a group consisting of (a) rectangular, (b) circular, and (c) elliptical.

16. The modular connector assembly of claim 14, wherein said sleeve-like member is attached to said inner surface region using a technique selected from a group consisting of (a) adhesive attachment and (b) thermal bond attachment.

17. The modular connector assembly of claim 11, wherein said connector body is fabricated from a material selected from a group consisting of (a) rubber, and (b) plastic.

18. The modular connector assembly of claim 11, wherein said modular connector is selected from a group consisting of (a) a telephone modular connector, (b) a network modular connector, and (c) a communications system modular connector.

19. A method to prevent unintended disconnection between a receptacle mated with a modular connector having a connector tail, the method comprising the following steps:

(a) providing a sleeve that includes a hood having a front portion defining a first cavity sized to fit over at least a rear portion of said modular connector, said first cavity communicating through a rear portion of said hood to define an opening sized to admit a cable attachable to said modular connector, said hood further defining a second cavity configured to accept at least a distal portion of said connector tail and to arrest movement of said distal portion in a direction that would unmate said modular connector from said receptacle, said hood including a wall portion separating at least part of said first and said second cavity; and (b) sliding said sleeve over said rear portion of said modular connector such that at least a distal portion of said connector tail is received within said second cavity.

20. The method of claim 19, wherein step (a) includes forming said first cavity and said second cavity in a single piece of material comprising said sleeve.

* * * * *